United States Patent [19]

Cheek

[11] Patent Number: 4,507,155

[45] Date of Patent: Mar. 26, 1985

[54] CLEANING COMPOSITION AND METHOD

[76] Inventor: Robert H. Cheek, 1042 Buchanan St. NE., Washington, D.C. 20017

[21] Appl. No.: 511,960

[22] Filed: Jul. 8, 1983

[51] Int. Cl.[3] ..... B08B 3/08; C11D 7/06; C11D 7/24; C11D 7/26; C11D 7/30

[52] U.S. Cl. ..... 134/6; 101/424; 134/40; 252/158; 252/171

[58] Field of Search ..... 134/6, 40; 252/158, 252/159, 171, 364; 101/424

[56] References Cited

U.S. PATENT DOCUMENTS

| | | | |
|---|---|---|---|
| 114,464 | 5/1871 | Neill . | |
| 224,841 | 2/1880 | Nordaby . | |
| 450,431 | 4/1891 | Seeberger . | |
| 618,592 | 1/1899 | Wegerdt . | |
| 1,184,164 | 5/1916 | Blackmore . | |
| 1,447,734 | 3/1923 | Schwenterley . | |
| 1,501,086 | 7/1924 | Zimmerman . | |
| 1,744,648 | 1/1930 | Lane et al. . | |
| 2,271,491 | 1/1942 | Rathke . | |
| 2,622,038 | 12/1952 | Charlesworth et al. . | |
| 2,697,674 | 12/1954 | Eisen . | |
| 3,342,740 | 9/1967 | Kazmierczak et al. . | |
| 3,354,088 | 11/1967 | Elmquist | 252/159 X |
| 3,373,115 | 3/1968 | Steppan | 252/153 |
| 3,625,854 | 12/1971 | Gower et al. | 252/171 |
| 3,679,479 | 7/1972 | Ray et al. | 134/40 |
| 3,755,184 | 8/1973 | Mizuno | 252/171 |
| 3,772,205 | 11/1973 | Dongas | 252/171 |
| 3,773,677 | 11/1973 | Boyles | 134/40 X |
| 3,806,460 | 4/1974 | Mukai et al. . | |
| 3,813,342 | 5/1974 | Cooperman | 252/171 X |
| 3,817,871 | 6/1974 | Graff . | |
| 3,887,497 | 6/1975 | Ulvild | 252/158 X |
| 4,199,482 | 4/1980 | Renaud et al. | 252/171 X |
| 4,302,365 | 11/1981 | Holmgren et al. . | |
| 4,435,305 | 3/1984 | Tsoukalas et al. | 252/158 |

*Primary Examiner*—Marc L. Caroff

*Attorney, Agent, or Firm*—Banner, Birch, McKie & Beckett

[57] ABSTRACT

A cleaning composition particularly suited for removing dried printing ink residue from a substrate is described comprising a chlorinated hydrocarbon liquid, a petroleum distillate, an aliphatic alcohol and aqueous ammonia.

10 Claims, No Drawings

CLEANING COMPOSITION AND METHOD

BACKGROUND OF THE INVENTION

1. Field of the Invention

This invention broadly pertains to a cleaning composition and particularly relates to a composition for removing dried printing ink from printing equipment such as printing rollers. The composition also is useful as a spot remover for removing various stains from textile articles.

2. Description of the Prior Art

Organic solvents are used widely for removing printing ink, oils, greases, etc., from printing equipment and other machinery. Cloths soaked in mineral spirts, gasoline, kerosene, naphtha, isopropanol, denatured alcohol and methyl ethyl ketone generally are used to wipe the equipment, e.g, rubber printing rollers, clean immediately after use. Some of these solvents, however, disadvantageously cause localized swelling of rubber rollers which interferes with proper operation of the printing equipment.

U.S. Pat. No. 3,773,676 describes a non-inflammable mixed solvent system consisting of low- and high-boiling non-inflammable halogenated hydrocarbon liquids such as methylene chloride and perchloroethylene and a light petroleum solvent such as mineral spirits useful for removing ink, grease, oil and other material from printing equipment.

As long as these materials are used immediately, the above-described organic solvents satisfactorily remove printing inks from printing equipment, although as noted above some may cause undesirable localized swelling of rubber printing rollers. However, if the printing ink is permitted to dry overnight or for more extended periods, the hard, crystallized residue is extremely difficult to remove using conventional solvents.

It is an object of the present invention to provide an improved solvent for cleaning printing equipment.

It is another object of this invention to provide a cleaning solvent that is as easy to handle and as safe to use as other available cleaning compositions.

It is a further object of this invention to provide a cleaning solvent that can successfully remove dried printing ink from printing equipment, particularly rubber printing rollers.

It is still a further object of this invention to provide a cleaning solvent which is also useful for removing spots such as grease, food stains, etc., from textile articles.

These and other objects which will become apparent from the following description are provided by the present invention.

SUMMARY OF THE INVENTION

The present invention provides a cleaning composition comprising about 5–35 percent by volume of a chlorinated hydrocarbon liquid; about 5–35 percent by volume of a petroleum distillate, about 30–50 percent by volume of an aliphatic alcohol and about 10–40 percent by volume aqueous ammonia.

The present invention also provides a method for removing dried printing ink residue from a substrate comprising the steps of applying to the substrate a cleaning composition comprising about 10–35 percent by volume of a chlorinated hydrocarbon liquid, about 5—35 percent by volume of a petroleum distillate, about 30–50 percent by volume of an aliphatic alcohol and about 10–40 percent by volume aqueous ammonia, and wiping away the cleaning composition and dissolved ink residue from the substrate.

The method of the present invention is particularly suitable for removing dried printing ink residue from rubber printing rollers.

DETAILED DESCRIPTION OF THE INVENTION

The present invention provides an improved composition for removing dried printing ink from printing equipment such as rubber printing rollers, presses, type, etc. As used herein, the phase "rubber printing rollers" broadly refers to printing rollers composed of a material which is susceptible to swelling from the application of certain organic solvents such as aliphatic alcohols, e.g., methanol or ethanol. The composition may possibly be used as well for removing various other types of spots and stains from textile articles such as carpets, upholstery, clothing, etc., depending upon their fiber composition.

The individual ingredients which make up the composition of the present invention are separately known, and each are used in cleaning compositions for various purposes. However, the specific combination of ingredients which comprises the novel composition of the present invention is not disclosed in the prior art. Moreover, the prior art does not disclose the same or similar composition in connection with the removal of dried printing ink residue from printing equipment and the like, particularly from rubber printing rollers.

In accordance with the present invention about 5–35 percent by volume of a chlorinated hydrocarbon liquid about 5–35 percent by volume of a petroleum distillate, about 30–50 percent by volume of an aliphatic alcohol and about 10–40 percent by volume aqueous ammonia are blended together to form the cleaning composition. Although the composition consists of separate, immiscible organic and aqueous phases, a uniform organic-in-aqueous dispersion of sufficient stability for application to the substrate to be cleaned is created simply by vigorous shaking.

If desired, a more stable emulsion of the two phases may be provided by adding an appropriate emulsification agent or surfactant to the composition, as will be recognized by one skilled in this art. No generalized statement can be made specifying the exact quantity and type of surfactant which may be used to produce a suitable fluid emulsion of the water-immisible organic phase and aqueous phase. However, as noted above, the cleaning composition of the present invention can be used satisfactorily without any surfactant whatsoever.

Suitable chlorinated hydrocarbons for use in the present invention are those having a boiling point within the range of about 60° to 175° C. and include, for example, chloroform, carbon tetrachloride, trichloroethane, tetrachloroethane, pentachloroethane, trichloroethylene and perchloroethylene. Perchloroethylene is the preferred chlorinated hydrocarbon ingredient. A composition containing perchloroethylene as the chlorinated hydrocarbon component has exhibited particularly superior removal of dried printing ink residue from rubber printing rollers. If desired, a small amount, e.g., about 0–20 percent based on the chlorinated hydrocarbon, of a low boiling (35° C. to 50° C.) chlorinated hydrocarbon liquid such as methylene chloride can also be added.

Mixtures of chlorinated hydrocarbons are also contemplated by this invention. The chlorinated hydrocarbon must be present in the composition in an amount by volume of from about 5–35 percent.

Petroleum naptha is the preferred petroleum distillate for use in the cleaning composition of this invention. Petroleum naptha is a generic term applied to refined, partially refined or unrefined petroleum products and liquid products recovered from natural gas wherein at least 10 percent distill below 347° (175° C.) and at least 95 percent distll below 464° F. (240° C.) when subjected to the standard testing method for distilling gasoline. Other suitable petroleum distillates, some of which are encompassed by the generic term naptha, include mineral spirits, Stoddard solvent and ligroin. Other suitable petroleum distillates will be apparent to one skilled in this technoloty. The petroleum distillate also must be present in the cleaning composition in an amount by volume of from about 5–35 percent.

Preferably, a product marketed under the tradename BLANKROLA and available from Multigraphic Division, A. M. Corporation 1800 West Central Rd., Mt. Prospect, Ill. as an all-purpose solvent for cleaning printing equipment conveniently is used as the source of both the chlorinated hydrocarbon liquid and the petroleum distillate. BLANKROLA contains both perchloroethylene and petroleum naptha in a proportion suitable for use in the present invention. A cleaning composition containing BLANKROLA has exhibited particularly superior removal of dried printing ink residue from rubber printing rollers. When using BLANKROLA, about 30–50 percent by volume based on the total cleaning composition must be used. Preferably, about 33–40 percent by volume, BLANKROLA is used when formulating the cleaning composition.

The third component of the cleaning composition is an aliphatic alcohol. This ingredient must be present in an amount by volume of from about 30–50 percent; preferably about 33–40 percent is used. Suitable aliphatic alcohols include methyl, ethyl and isopropyl alcohols. Denatured alcohol conveniently may be used.

The final component, ammonia, is added as an aqueous solution, i.e. as ammonium hydroxide. Ammonia concentrations in the aqueous solution up to about 30 percent are possible. Simple household ammonia can conveniently be used. When using aqueous ammonia, about 10–40 percent by volume based on the cleaning composition must be used in the formulation. The more concentrated the ammonia solution, the less needed in the cleaning composition. Preferably, to minimize the burning discomfort associated with concentrated ammonia solutions, this ingredient is blended into the cleaning composition at no more than about 20–33 percent by volume.

It is also possible to add the ammonia as an alcohol solution; the required amount of water also must be added separately to minimize loss of ammonia from the cleaning composition. The amount of alcohol-ammonia solution (aromatic spirits of ammonia) and water equivalent to the amount of alcohol and aqueous ammonia recited in the basic formulation is readily calculable by one skilled in the art.

In addition to a surfactant, the cleaning composition optionally may also contain an inorganic cleaner; e.g., sodium, potassium, or ammonium carbonate, trisodium, tripotassium or trilithium phosphate, or borax; an abrasive such a silica, although an abrassive generally would not be used in connection with the cleaning of rubber printing rollers; a viscosity modifier or thickening agent, which allows the composition to remain in contact with the substrate longer without running; and/or a humectant, e.g., propylene or polyethylene glycol. The humectant may provide additional solvent action to the composition.

The cleaning solvent of this invention can be applied to a substrate in the conventional manner, e.g., by soaking a clean cloth therewith and wiping/rubbing the soiled workpiece. The solvent also may be applied from a pump spray dispenser or squeeze bottle. Generally, sufficient solvent is applied to wet completely the affected area. After waiting a brief period for the solvet to act, additional cleaning solution is applied to the substrate and then the soiled area is wiped vigorously with a clean cloth. If the area is not completely cleaned after the first application, the above steps are repeated.

The following examples are included for illustrative purposes only and are not intended to limit the scope of this invention. These examples illustrate preferred compositions of the present invention. Percentages are based on the volume of the total cleaning composition.

EXAMPLE I

| | |
|---|---|
| BLANKROLA | 40% |
| Denatured alcohol | 40% |
| Household ammonia | 20% |

EXAMPLE II

| | |
|---|---|
| BLANKROLA | 33.3% |
| Denatured alcohol | 33.3% |
| Household ammonia | 33.3% |

Testing of the cleaning compositions of the present invention has shown that it is a more effective solvent for cleaning heavily soiled printing equipment, particularly dried printing ink from rubber rollers, than solvents used in the prior art. Other solvents tested for comparison with the cleaning composition of the present invention included pure BLANKROLA and VARSOL. VARSOL is a straight aliphatic petroleum solvent used as a paint thinner, for dry cleaning and for general plant machinery cleaning. Upon vigorous agitation and proper application, the composition of this invention worked best for removing dried printing ink from printing equipment. Surprisingly, use of the cleaning composition of this invention, which contains a sizable portion of an aliphatic alcohol, did not cause localized swelling of rubber printing rollers.

Additional testing also has shown the cleaning composition of this invention to be an excellent spot remover for removing stains from textile articles such as clothing, upholstery, carpeting and the like.

While preferred embodiments of this invention have been discussed herein, those skilled in the art will appreciate that changes and modifications may be made without departing from the spirit and scope of this invention, as defined in and limited only by the scope of the appended claims.

I claim:

1. A cleaning composition consisting essentially of about 5–35 percent by volume of a chlorinated hydrocarbon liquid selected from the group consisting of chloroform, carbon tetrachloride, trichloroethane, tetrachloroethane, pentachloroethane, trichlorethylene and perchloroethylene, about 5–35 percent by volume of a petroleum distillate selected from the group consisting of petroleum naphtha, mineral spirits, Stoddard solvent and ligroin, about 30–50 percent by volume of an aliphatic alcohol selected from the group consisting of methyl alcohol, ethyl alcohol and isopropyl alcohol, and about 10–40 percent by volume aqueous ammonia.

2. The cleaning composition of claim 1 consisting essentially of about 33–40 percent by volume of a mixture of perchloroethylene and petroleum naptha, about 33–40 percent by volume of ethyl alcohol and about 20–33 percent by volume aqueous ammonia.

3. The composition of claim 2 wherein said ethyl alcohol is denatured.

4. A cleaning composition consisting essentially of about 5–35 percent by volume perchloroethylene, about 5–35 percent by volume petroleum naptha, about 30–50 percent by volume ethyl alcohol and about 10–40 percent by volume aqueous ammonia.

5. The cleaning composition of claim 4 wherein said ethyl alcohol is denatured.

6. A method of removing dried printing ink residue from a substrate comprising the steps of applying to the substrate a cleaning composition consisting essentially of about 5–35 percent by volume of chlorinated hydrocarbon liquid selected from the group consisting of chloroform, carbon tetrachloride, trichloroethane, tetrachloroethane, pentachloroethane, trichloroethylene and perchloroethylene, about 5–35 percent by volume of a petroleum distillate selected from the group consisting of petroleum naphtha, mineral spirits, Stoddard solvent and ligroin, about 30–50 percent by volume of an aliphatic alcohol selected from the group consisting of methyl alcohol, ethyl alchol and isopropyl alcohol and about 10–40 percent by volume aqueous ammonia; and wiping away the cleaning composition and dissolved ink residue from the substrate.

7. The method of claim 6 wherein the cleaning composition consists essentially of about 33–40 percent by volume of a mixture of perchloroethylene and petroleum naptha, about 33–40 percent by volume of ethyl alcohol and about 20–33 percent by volume aqueous ammonia.

8. The method of claim 6 wherein the cleaning composition consists essentially of perchloroethylene as said chlorinated hydrocarbon, petroleum naptha as said petroleum distillate, and ethyl alcohol as said aliphatic alcohol.

9. The method of claim 7 wherein said ethyl alcohol is denatured.

10. The method of claim 8 wherein said ethyl alcohol is denatured.

* * * * *